United States Patent [19]

Mano et al.

[11] Patent Number: 4,965,563

[45] Date of Patent: Oct. 23, 1990

[54] FLAT DISPLAY DRIVING CIRCUIT FOR A DISPLAY CONTAINING MARGINS

[75] Inventors: Hiroyuki Mano, Yokohama; Kiyoshige Kinugawa, Chiba; Satoru Tsunekawa, Tachikawa, all of Japan

[73] Assignee: Hitachi, Ltd., Tokyo, Japan

[21] Appl. No.: 249,993

[22] Filed: Sep. 27, 1988

[30] Foreign Application Priority Data

Sep. 30, 1987 [JP] Japan ..... 62-243711

[51] Int. Cl.[5] ..... G09G 3/20

[52] U.S. Cl. ..... 340/784; 340/805

[58] Field of Search ..... 340/784, 730, 765, 805; 350/353, 332, 333

[56] References Cited

U.S. PATENT DOCUMENTS

| | | | |
|---|---|---|---|
| 4,656,470 | 4/1987 | Saka | 350/332 |
| 4,740,786 | 4/1988 | Smith | 350/332 |
| 4,748,444 | 5/1988 | Arai | 350/333 |
| 4,759,609 | 7/1988 | Clerc | 350/333 |
| 4,778,260 | 10/1988 | Okada et al. | 350/332 |
| 4,804,952 | 2/1989 | Hara | 340/730 |
| 4,824,212 | 4/1989 | Taniguchi | 340/784 |

OTHER PUBLICATIONS

Hitachi Microcomputor System, LCD Timing controller (LCTC) HD 63645F/HD 64645F User's Manual.

*Primary Examiner*—Alvin Oberley

*Attorney, Agent, or Firm*—Antonelli, Terry, Stout & Kraus

[57] ABSTRACT

A flat display driver in a drive circuit for driving a flat display including a memory storing data to be displayed on a display panel of a line scan type having a two-dimensional structure constituted with N rows by M columns, an address generator for generating a read address of the memory and a line clock signal, a data output terminal for supplying the display panel with data read from the memory, and a line clock signal output terminal for supplying the line clock signal from the address generator to the display panel. The memory is loaded at least with display data constituted with K rows by M columns ($K<N$) and the driver further includes a margin scan detect device in which respective margin lines ($(N-KO/2)$ in upper and lower portions of the display panel are set in advance for receiving and for counting the line clock from the address generator, thereby detecting a margin detect signal when the count in equal to a value corresponding to the margin line and a margin display output device operative in response to an input of the margin detect signal from the margin detect device for outputting a margin display signal to the display panel.

8 Claims, 16 Drawing Sheets

FLAT DISPLAY DRIVING CIRCUIT FOR A DISPLAY CONTAINING MARGINS

BACKGROUND OF THE INVENTION

The present invention relates to a flat panel driving circuit for driving a display panel of a line scanning type having a two-dimensional structure such as a liquid crystal panel, a plasma display, and an electroluminescence panel, and in particular, to a liquid crystal driving circuit suitable for an operation when a screen to be displayed is smaller than the screen size of the crystal panel.

As conventional flat panel driving circuits to drive the liquid crystal, there is known a liquid crystal controller HD63645F/HD64645F (to be simply referred to as LCTC herebelow) described in the Hitachi Microcomputer System LCD Timing Controller (LCTC) HD63645F/HD64645F User's Manual and a video interface controller described in the Japanese Patent Unexamined Publication JP-A-61-174595. According to these controllers, display data for a screen is stored in a frame memory such that the information thus stored is sequentially read out therefrom so as to be supplied to a liquid crystal panel together with a liquid crystal drive signal, thereby displaying the screen image on the crystal panel. In these liquid crystal controllers, however, consideration has not been given to the case where the size of the screen of the liquid crystal panel is greater than the display screen size.

Operations of the conventional liquid crystal controller will be described in detail by use of FIGS. 1 to 4. FIG. 1 shows a block diagram of a conventional liquid crystal display apparatus comprising an address generator 1, a display address signal 2, signals 3 to 5 for driving a liquid crystal panel, a line clock 3, a first line signal 4, and a data shift clock 5. The configuration further includes a frame memory 6 for storing therein display data for a screen, liquid crystal display data read from the frame memory 6 according to the display address 2, and a liquid crystal panel 8 for displaying the liquid crystal display data 7 as visible information. FIG. 2 is a signal timing chart showing operations of the crystal display apparatus of FIG. 1. FIG. 3 is a diagram showing relationships between the frame memory 6 and the liquid crystal panel 8; whereas FIG. 4 is a diagram illustrating relationships between the frame memory 6 and the liquid crystal panel 8 in a case where the size of the liquid crystal panel 8 is larger than the display area.

In the system of FIG. 1, the address generator 1 generates a display address for a screen and sends the display address 2 to the frame memory 6. The frame memory 6 outputs as liquid crystal display data 7 display data stored at an address indicated by the display address 2; in consequence, assuming that the liquid crystal display data 7 includes 4-bit parallel data, in a case of a display of, for example, 640×400 dots, the address generator 1 sequentially generates 64000 (640×400÷4=64000) addresses ranging from OH (hexadecimal) to F9FFH (hexadecimal), which are then supplied therefrom to the frame memory 6. The frame memory 6 outputs 64000 data items as the liquid crystal display data 7 according to the addresses thus produced. The liquid crystal display data 7 is, as shown in FIG. 2, transmitted to the liquid crystal panel together with the data shift clock 5, the line clock 3, and the first line signal 4 respectively outputted from the address generator 1.

Referring now to FIG. 2, description will be given of the display operation of the liquid crystal panel 8. The liquid crystal panel 8 receives data at a rising edge of the data shift clock 5. Concretely, on receiving data for a display line, namely, 160 liquid crystal display data items 7 ranging from data item 0 to data item 159, the liquid crystal panel 8 displays the data for a line in response to the line clock 3. When this operation is repeatedly effected 400 times, control returns to the first line. The first line signal 4 designating which one of data items corresponds to the first line is, as shown in FIG. 2, outputted at a timing when the signal 4 becomes high in response to an output of the line clock 3 displaying the data of the first line, thereby accomplishing the data display for the first line. In consequence, as for the relationship between the data in the frame memory and that displayed on the liquid crystal panel 8, information stored in the frame memory 6 is directly displayed on the crystal panel 8 as shown in FIG. 3.

According to the prior art technology above, considerations have not been given to a case where a data area to be displayed is smaller than the liquid crystal panel 8. That is, for example, in a case where 640×400 dots are to be displayed on a panel having 640×480 dots, and in particular, where the display of 640×400 dots is effected on the center of the liquid crystal panel 8, it is necessary to respectively store margin data of 40 lines, as shown in FIG. 4, in the upper and lower portions of the display data of 640×400 dots in the frame memory 6 such that the data are sequentially read from the frame memory 6 so as to display the data on the liquid crystal panel 8. In this display method, however, when the operation speed of the liquid crystal display apparatus is taken into consideration, in a case where the display of 640×400 dots is achieved by use of a panel of 640×400 dots, although a frame frequency of 70 Hz can be developed through an operation at a rate of 18 MHz/dot, if a panel of 640×480 dots is used in this case, the frame frequency becomes 58 Hz for the conventional 18 MHz/dot operation and hence beyond the operation range 65 to 75 Hz of the liquid crystal, namely, if the frame frequency of 70 Hz is developed, a 21.5 MHz/dot operation becomes necessary, which leads to a problem that a high-speed device is required when the panel of 640×400 dots is used.

SUMMARY OF THE INVENTION

It is therefore an object of the present invention to enable a display area to be displayed at the center of a liquid crystal panel without increasing the operation speed of the liquid crystal display apparatus even when the screen size of the liquid crystal panel is greater than the display size of the display area, thereby solving the problem above.

The object above can be achieved by disposing a margin scan detect unit, a high-speed line clock generate unit, a first line signal convert unit, and a line clock change-over or switch unit such that the operation for the display of the margin data is achieved at a speed which is N (an integer) times the operation speed for the display portion when the scanning is effected in the vertical direction and that the margin data is displayed with an N-time magnification in the vertical direction so as to minimize the amount of the margin data, thereby displaying the required number of lines of the margin data in the upper and lower portions of the display data without increasing the operation speed of the liquid crystal display apparatus.

The margin scan detect device is disposed to detect the portions of the margin data in the display operation on the liquid crystal panel, and a high-speed indicate signal is set to "High" when the margin data is to be displayed. The high-speed line clock unit generates a high-speed line clock having a speed which is N times the speed of the conventional line clock; whereas the first line signal convert device converts the first line signal to a signal conforming to a timing suitable for the high-speed line clock, thereby outputting a high-speed first line signal. The line clock change-over means changes over the line clock to the high-speed line clock in a case where the high-speed indicate signal is "High", namely, the liquid crystal panel is displaying margin data, thereby magnifying the displayed margin data by N in the vertical direction.

In addition, according to another configuration example of the present invention, only the display data is stored in the frame memory, namely, the margin data is not stored therein such that gate means are inserted between the frame memory and a data output terminal so as to generate a high-speed line clock signal, like in the configuration above, when a line clock output corresponds to the margin data and so as to open the gate means to stop the data output to the data output terminal, thereby terminating the data supply to the margin portion.

Furthermore, according to still another configuration example, a display panel of a scanning type having a two-dimensional structure includes a liquid crystal panel such that regardless of whether or not margin data is stored in the frame memory, the frequency of the high-speed line clock signal is set higher than that associated with the response speed of the liquid crystal panel so as to disable the liquid crystal element to follow the operation, thereby achieving the margin display.

BRIEF DESCRIPTION OF THE DRAWINGS

The present invention will be apparent from the following detailed, description taken in conjunction with the accompanying drawings in which.

DESCRIPTION OF THE PREFERRED EMBODIMENTS

Referring now to FIGS. 5 to 16, description will be given of an embodiment according to the present invention. In this embodiment, it is assumed that a display of $640\times400$ dots is achieved on a panel of $640\times480$ dots and that the high-speed line clock has a speed which is ten times the line clock, namely, $N=10$.

Figure 5:
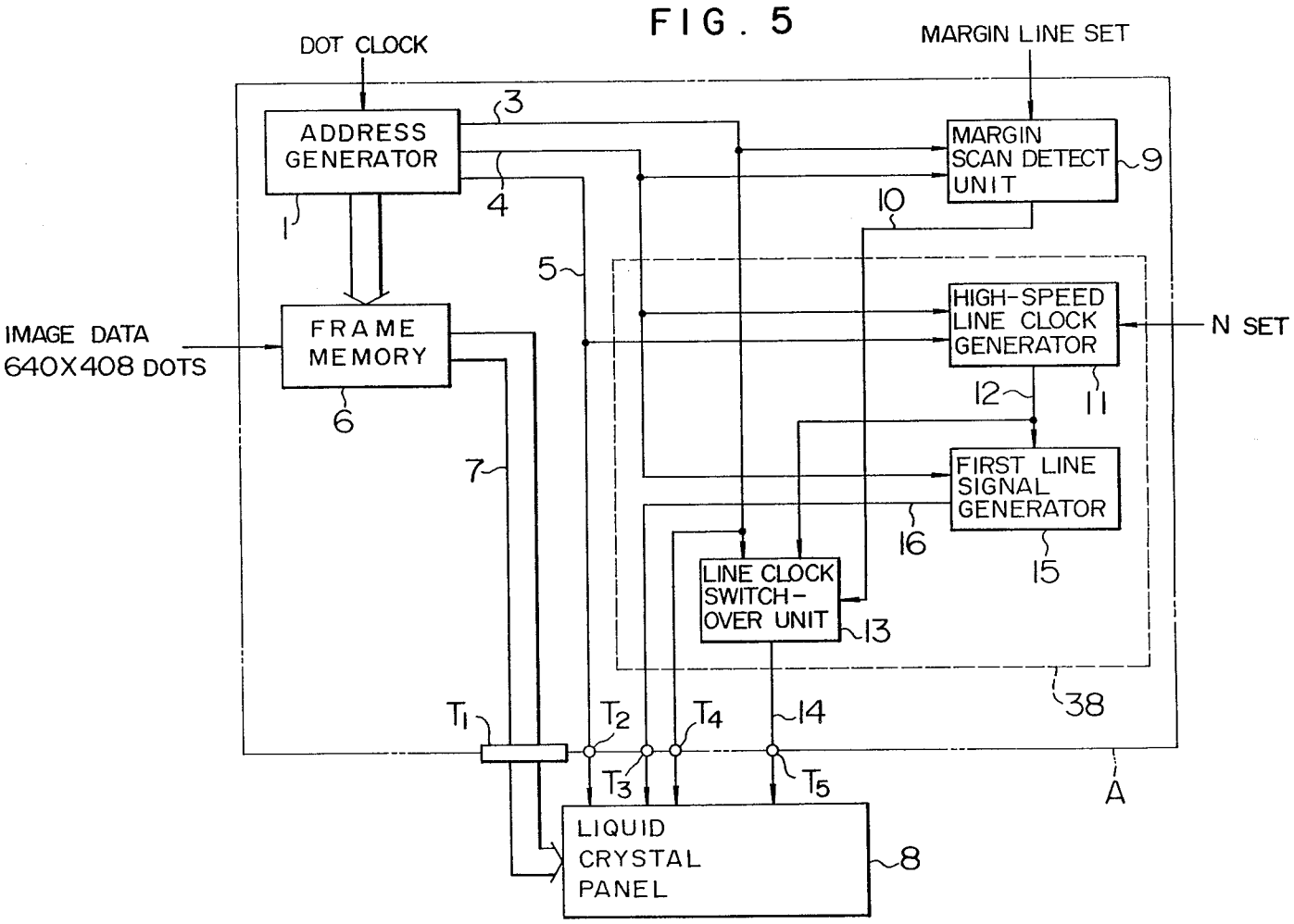
FIG. 5 is a block configuration diagram of a circuit driving a liquid crystal display apparatus as an embodiment according to the present invention.

FIG. 5 shows an embodiment of a circuit for driving a liquid crystal display device to which the present invention is applied. A portion enclosed with broken lines is a liquid crystal drive circuit A according to the present invention, which is connected via terminals $T_1$ to $T_5$ to a liquid crystal panel 8.

In this configuration, the liquid crystal drive circuit A includes a frame memory 6, a margin scan detect device 9, and a margin display output unit 38. The margin display output unit 38 comprises a high-speed line clock generator 11, a first line signal converter 15, and a line clock switch device 13. Next, description will be given of the components of this system.

The margin scan detect device 9 is used to detect a scan position where margin data is being displayed on the liquid crystal panel 8. Reference numeral 10 denotes a high speed indication signal supplied from the margin scan detect device 9. This signal is set to "High" when the count value associated with the first line signal 4 corresponds to a line where margin data is displayed on the liquid crystal panel 8. Reference numerals 11 and 12 indicate a high-speed line clock generator and a high-speed line clock, respectively. The high-speed line clock generator 11 generates, according to an external setting, a high-speed line clock 12 of a speed which is ten times the speed of the line clock 3 in this case. Reference numerals 13 and 14 designate a line clock switch or change-over device and a liquid crystal line clock, respectively. The line clock switch device 13 selects the high-speed line clock 12 when the high speed indication signal 10 is "High" and selects the line clock 3 when the signal 10 is "Low", thereby outputting the selected clock as a liquid crystal line clock 14.

Figure 1:
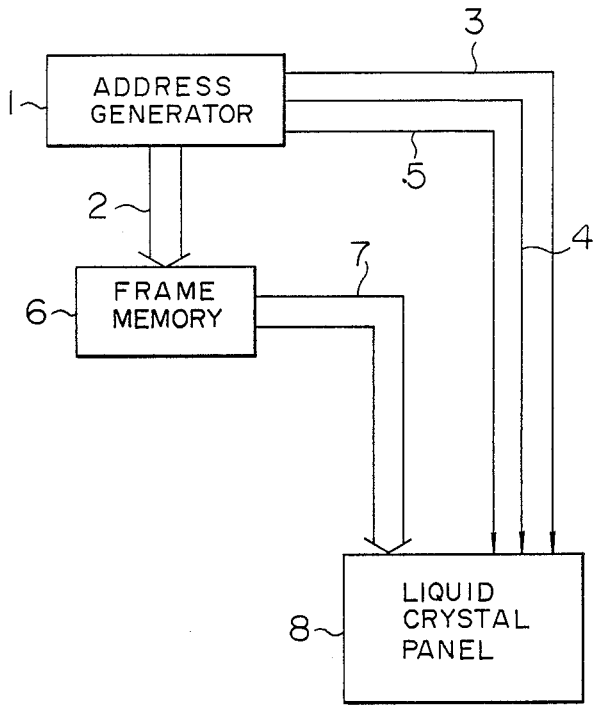
FIG. 1 PRIOR ART
FIG. 1 is a schematic block diagram showing a configuration of a conventional liquid crystal display apparatus.
Figure 2:
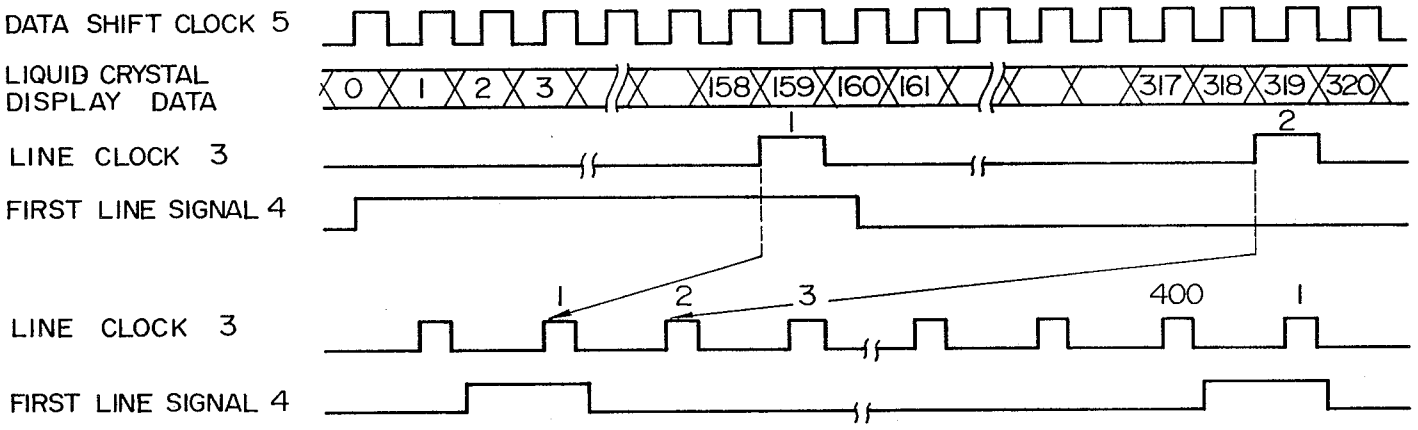
FIG. 2 PRIOR ART
FIG. 2 is a timing chart showing operations of the liquid crystal display apparatus of FIG. 1.
Figure 3:
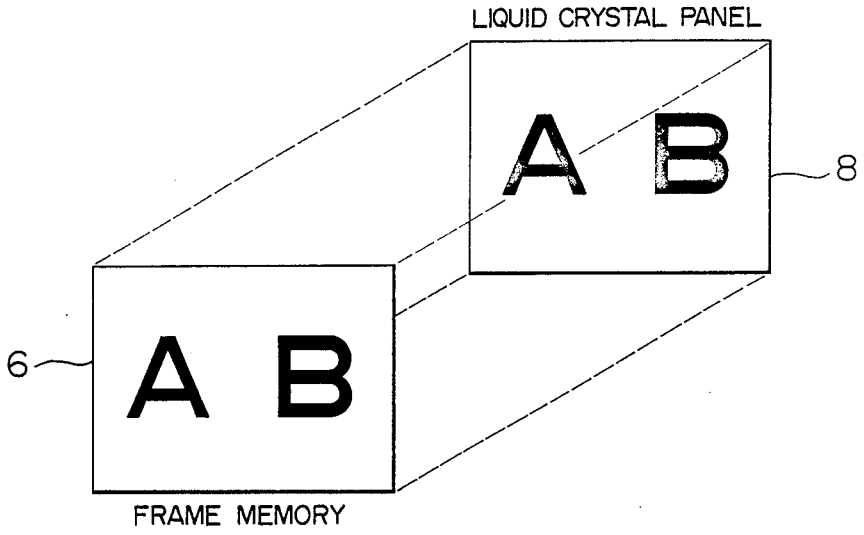
FIG. 3 PRIOR ART
FIG. 3 is a conceptual diagram showing relationships between information stored in a frame memory and display states of the information on a liquid crystal panel.
Figure 4:
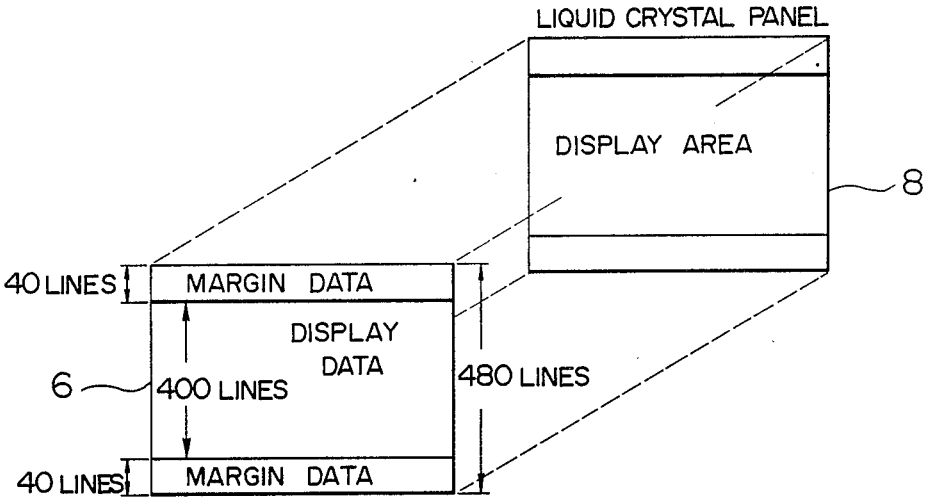
FIG. 4 PRIOR ART
FIG. 4 is a conceptual diagram showing interrelationships between the frame memory and the liquid crystal panel in a case where the size of the liquid crystal panel is greater than that of the display data.

Reference numerals 15 and 16 designate a first line signal converter and a high-speed first line signal, respectively. The first line signal converter 15 converts the first line signal 4 into a signal for the high-speed line clock 12 so as to output the high-speed first line signal 16. Incidentally, the components 1 to 8 are identical to those of FIG. 1.

Figure 6:
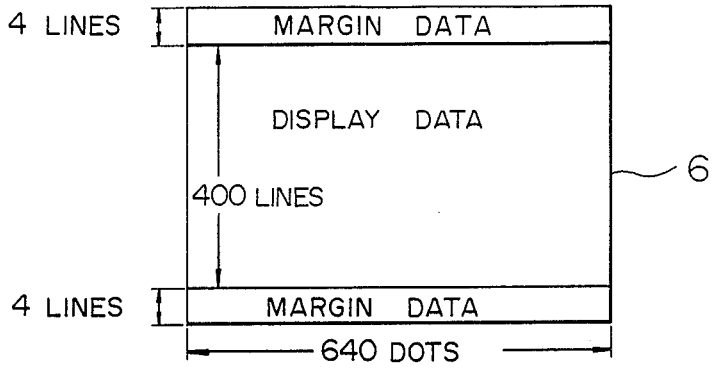
FIG. 6 is a conceptual diagram showing storage states of display data in the frame in the apparatus of FIG. 5.

FIG. 6 shows display data stored in the frame memory 6. In this embodiment, margin data of four lines are respectively located in the upper and lower portions of the display rate of 640 dots×400 lines to be actually displayed, thereby configuring the overall structure including 640 dots×408 lines.

Figure 7:
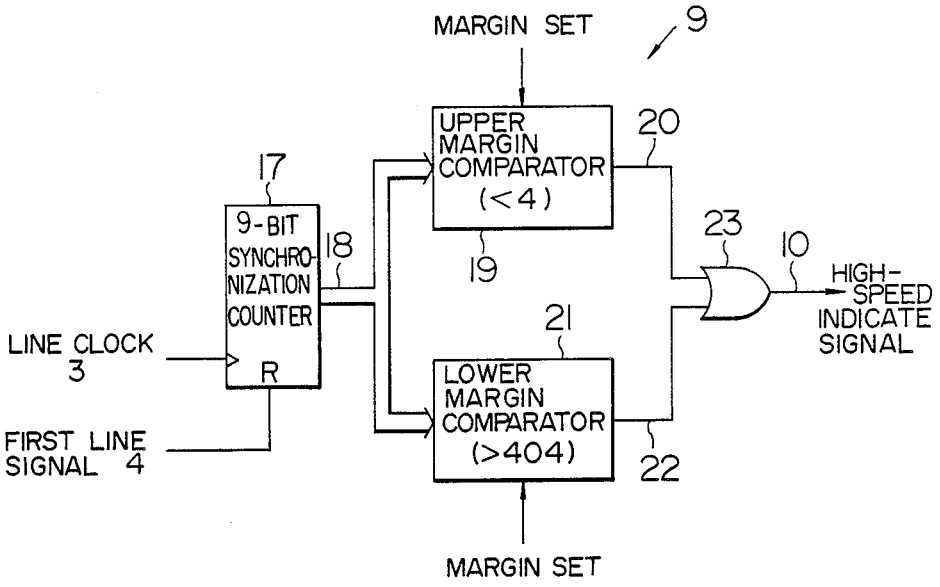
FIG. 7 is a circuit configuration diagram of a margin scan/detect device in the configuration of FIG. 5.

FIG. 7 shows an embodiment of the margin such detect device 9, which includes 9-bit synthronization counter 17 and a line count value 18. The 9-bit synthronization counter 17 counts the number of display lines on the liquid crystal panel 8 at a rising edge of the line clock 3 so as to produce a line count value 18 ranging from 0 to 207. Reference numerals 19 and 20 indicate an upper margin comparator and an upper margin signal, respectively. Each comparator is loaded with the number of lines for data stored in the frame memory 6 and the number of margin lines according to the display line count of the liquid crystal panel 8. The upper margin comparator 19 sets the upper margin signal 20 to "High" when the upper margin data of the display data is being scanned in the liquid crystal panel 8, namely, when the line count value 18 is in a range from 0 to 3. Reference numerals 21 and 22 indicate a lower margin comparator and a lower margin signal, respectively. The lower margin comparator 19 sets the upper margin signal 20 to "High" when the lower margin data of the display data is being scanned in the liquid crystal panel 8, namely, when the line count value 18 is more than 404. Reference numeral 23 is an OR gate, which sets the high speed indication signal 0 to "High" when the upper margin signal 20 or the lower margin signal 22 is "High".

Figure 8:
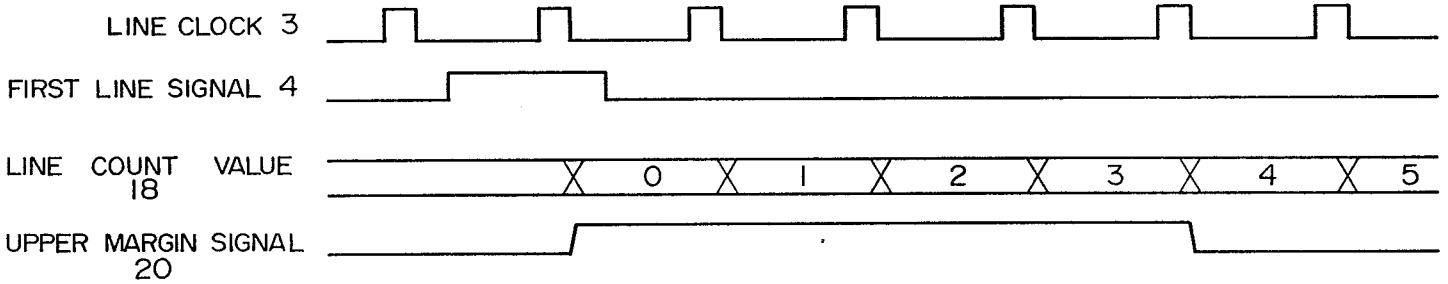
FIGS. 8 and 9 are timing charts showing operations of the margin scan/detect apparatus of FIG. 7.
Figure 9:
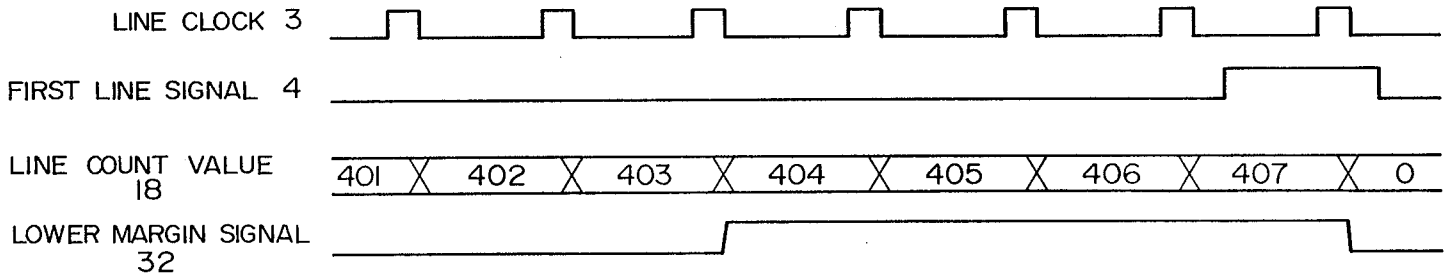

FIGS. 8 and 9 are signal timing diagrams for explaining the operation of the margin scan detect device 9.

In FIG. 7, the 9-bit synchronization counter 17 is reset, as shown in FIGS. 8 and 9, at a falling edge of the line clock when the first line signal 4 is "High" and thereafter the counting operation is effected at a falling edge of the line clock 3. The upper margin comparator 11 sets the upper margin signal 20 when the margin data of the four upper-most lines is being displayed on the liquid crystal panel 8. That is, as shown in FIG. 8, the upper margin signal 20 is set to "High" when the line count value is in a range from 0 to 3. The lower margin comparator 21 sets the lower margin signal 22 to "High" when the margin data of four lower-most lines is being displayed on the liquid crystal panel 8. That is, as shown in FIG. 9, the lower margin signal 22 is set to "High" when the line count value 18 is in a range from 404 to 407. As a result, the high speed indication signal 10 is continuously kept in the high level while the line count value 18 is in the ranges from 404 to 407 and from 0 to 3 for the period associated with eight lines.

Figure 10:
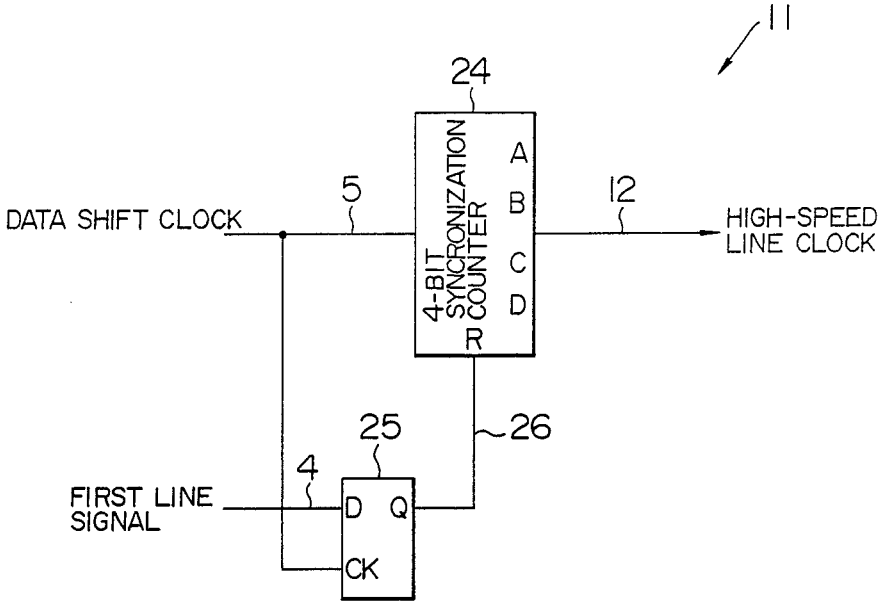
FIG. 10 is a schematic diagram showing a configuration example of a high-speed line clock generate device.
Figure 11:
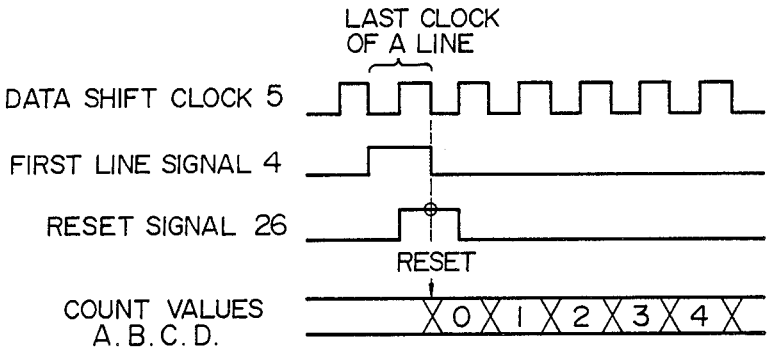
FIGS. 11 and 12 are timing charts showing operations of the high-speed line clock generator of FIG. 10.
Figure 12:
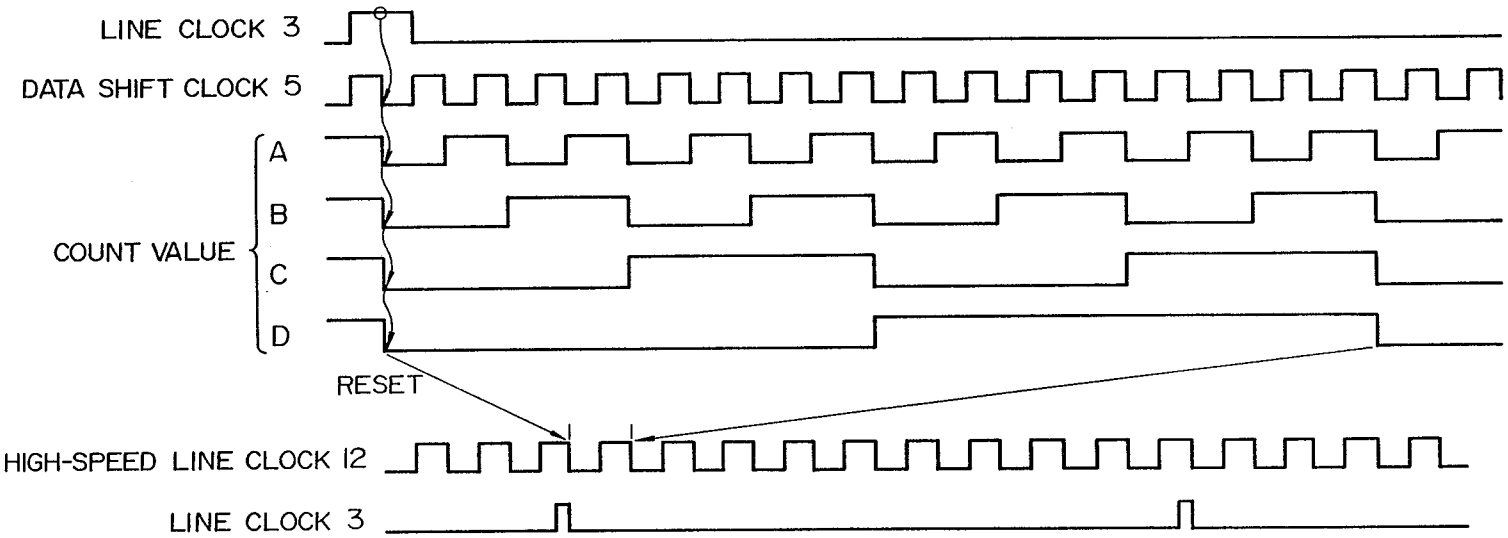

FIG. 10 shows an embodiment of the high-speed line clock generator 11 including a 4-bit synchronization counter 24 which starts operations thereof at a falling edge of the data shift clock 5 so as to deliver an output of the fourth bit as the high-speed line clock 12. Reference numeral 25 designates a fli-flop operating at the rising edge of the data shift clock 5, whereas reference numeral 26 indicates a reset signal for the 4-bit synchronization counter 24. FIG. 11 shows a signal timing chart useful to explain the reset operation of the 4-bit synchronization counter 24 of FIG. 10. FIG. 12 is a timing chart for explaining the operation of the high-speed lineclock generator 11 in which the 4-bit synchronization counter 24 is reset at the falling edge of the data shift clock 5 when the reset signal 26 is at the high level. As shown in FIG. 11, the first line signal 4 is set to the high level in this embodiment at a timing when a clock signal of the last data shift clock 5 of a line is outputted. A latch operation is effected by the flip-flop 25 at the rising edge of the data shift clock 5 so as to generate a reset signal 26 such that the 4-bit synchronization counter 24 is reset at the falling edge of the data shift clock 5 when the reset signal 26 is at the high level, namely, at the falling edge of the last clock of a line. The 4-bit synchronization counter 24 effects a count operation, as shown in FIG. 12, at a falling edge of the data shift clock 5. The D output therefrom as a high-speed line clock, namely, ten clock signals of the high-speed line clock 12 are outputted with a cycle of the line clock 3.

Figure 13:
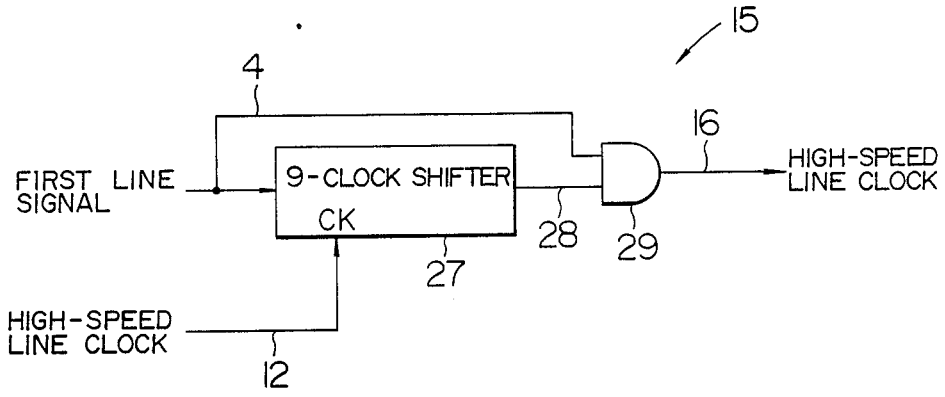
FIG. 13 is a circuit diagram showing a configuration example of a first line signal convert unit of FIG. 5.
Figure 14:
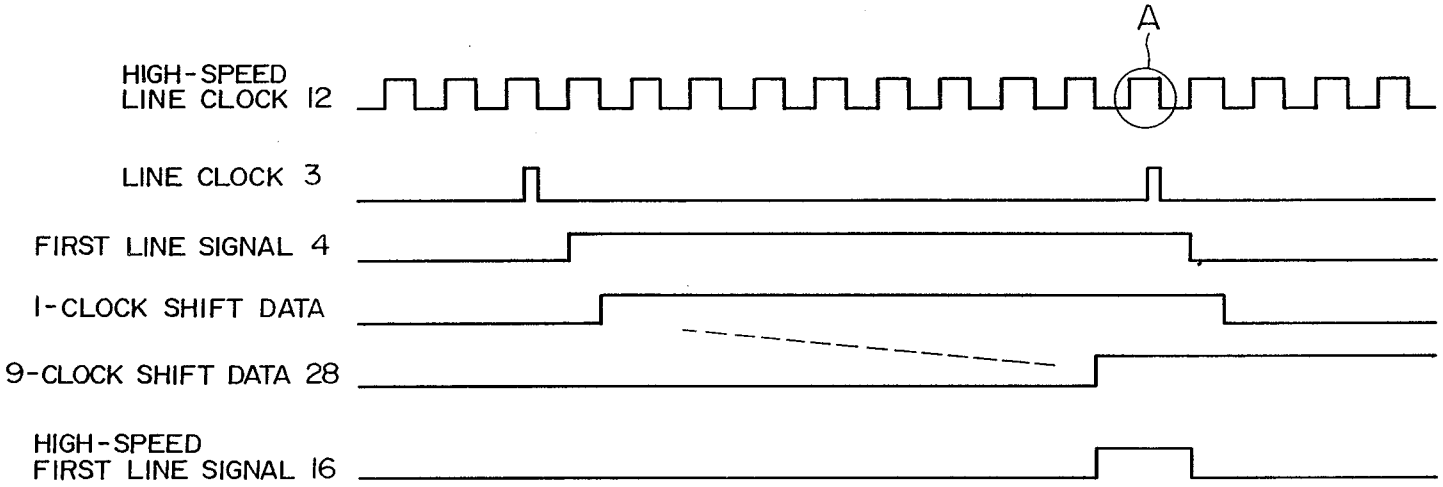
FIG. 14 is a timing chart showing operations of the first line signal convert unit of FIG. 13.

FIG. 13 shows an embodiment of the first line signal converter 15 including a 9-clock shifter 27, 9-clock shift data 28, and an AND circuit 29. FIG. 14 is a timing chart useful to explain the operation of the first line signal converter 15.

Referring now to FIG. 14, description will now be given of the operation of the first line signal converter 15. The first line signal 4 in this embodiment is at the high level for a cycle of the line clock 3. In consequence, while the first line signal 4 is at the high level, there are inputted ten clock signals of the high-speed line clock 12, which disables the normal operation of the liquid crystal panel 8. To overcome this difficulty, as shown in FIG. 13, there is disposed a 9-clock shifter 27 such that, as shown in FIG. 14, the 9-clock shift data 28 undergone a shift associated with nine clocks at a falling edge of the high-speed line clock 12 is ANDed with the first line signal 4, thereby generating a high-speed first line signal 16 of which the high level can be developed only at the falling edge of the clock signal of the high-speed line clock 12 synchronized with point A of FIG. 14, namely, the output position of the line clock 3.

Figure 16:
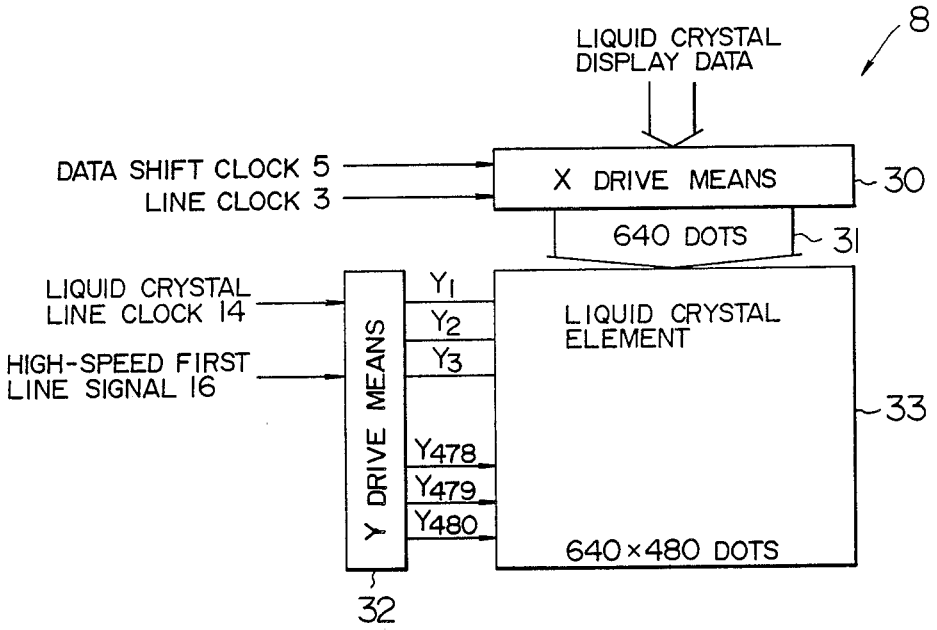
FIG. 16 is a configuration diagram schematically showing a configuration of a liquid crystal panel.
Figure 15:
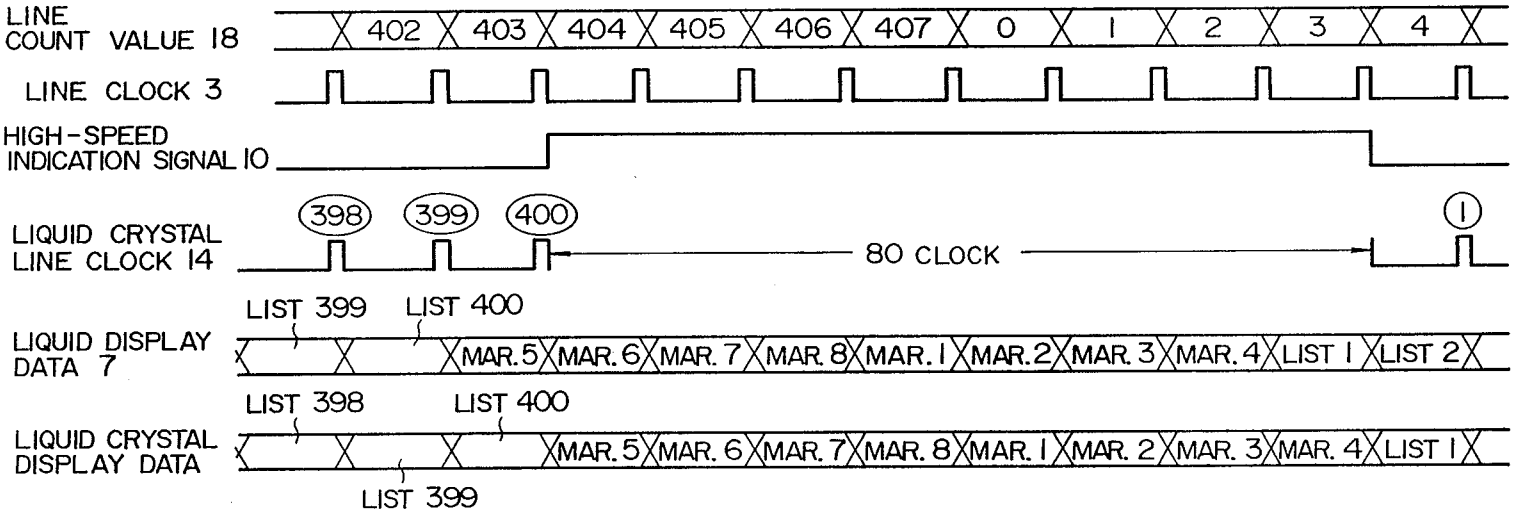
FIG. 15 is a timing chart showing a high-speed scan operation associated with margin data.

FIG. 15 is a timing chart showing a high-speed scan effected on margin data, whereas FIG. 16 shows a configuration of the liquid crystal panel 8 including X drive means 30, liquid crystal panel display data 31, Y drive means 32, line drive signals $Y_1$, $Y_2$, . . . , $Y_{480}$, and a liquid crystal element 33. In the liquid crystal element 33, the liquid crystal panel display data 31 is displayed on a line associated with one of the line drive signals $Y_1$ to $Y_{480}$ which is set to the high level. In consequence, the X drive means 30 sequentially delivers display data for a line as the liquid crystal panel display data 31 and the Y drive means 32 sequentially sets the line drive signals $Y_1$ to $Y_{480}$ to the high level according to the liquid crystal panel display data 31, thereby effecting a display of a screen.

In the block diagram of the liquid crystal display apparatus of FIG. 5, by use of the memory address outputted from the address generator 1, the display data stored in the frame memory 6 is sequentially read therefrom so as to be supplied as the liquid crystal display data 7 to the liquid crystal panel 8. It is assumed that the frame memory 6 in beforehand loaded, as shown in FIG. 6, with the margin data for four lines prior to and posterior to the display data for 400 lines. Consequently, in the read operation based on the memory address 2, the data is repeatedly read out n the sequence of the margin data for four lines, the display data for 400 lines, and the margin data for four lines.

The high-speed scan operation of the margin data will be described in conjunction with the operations of the devices above with reference to FIGS. 15 and 16. The margin scan detect device 9 sets the high speed indication signal 10 for the periods in which the line count value 18 is in the ranges from 404 to 407 and from 0 to 3. This causes the line clock switch device 13 to select the high-speed line clock 13 when the high speed indication signal 10 is at the high level so as to set the selected clock as the liquid crystal line clock 14. As a result, 400 clock signals of the liquid crystal line clock 14 are supplied with a cycle of the line clock 3 when the line count value 18 is in the range from 4 to 403 associated with the 400 lines; whereas 80 clock signals thereof are supplied with a cycle of the high-speed line clock 14 when the line count value 18 is in the ranges from 404 to 407 and from 0 to 3. The liquid crystal display data 7 read from the frame memory 6 is transferred while the line count value is in the ranges from 403 to 407 and 0 to 2, whereas the liquid crystal panel 8 receives the data thus transferred by use of the X drive means 30 of FIG. 16 in response to the data shift clock 5 so as to output the data as the liquid panel display data 31 to the liquid crystal element 33 at a falling edge of the line clock 3.

In consequence, as shown in FIG. 15, margin 1 to margin 8 constituting the margin data for eight lines are displayed as the liquid crystal panel display data 31 when the line count value is in the ranges from 404 to 407 and from 0 to 3 and the high speed indication signal 10 is at the high level. In this situation, the liquid crystal line clock 14 outputs, as described above, 80 clocks in the period associated with the eight lines because of the cycle of the high-speed line clock 12 so as to drive the Y drive means 32 of FIG. 16 by use of this clock; consequently, of the line drive signals $Y_1$ to $Y_{480}$ outputted from the Y drive means 32, $Y_1$ to $Y_{40}$ and $Y_{441}$ to $Y_{480}$ are effected by the clock and hence the corresponding 80 lines undergo a high-speed scan. Incidentally, the high speed indication signal 10 in the period from $Y_1$ to $Y_{40}$ is attained by latching the high state of the high-speed first line signal 16 in response to the high-speed line clock.

As described above, through the operations of the margin scan detect device 9, the high-speed line clock generator 11, the first line signal converter 15, and the line clock switch device 13, it is enabled that the margin data of 40 lines is displayed at a high speed in the upper and lower portion of the liquid crystal panel 8 of 640×480 dots during the 8-line period with each line magnified by ten in the vertical direction and that the display data of 400 lines are displayed at the center in a usual fashion.

As a result, the period of time required to transfer the margin data can be minimized, for example, as compared with a case where a display of 640×400 dots on a liquid crystal panel of 640×400 dots can be achieved in an operation speed of 18 MHz/dot for the frame frequency of 70 Hz, in a case where a display of 640×400 dots is to be effected on a liquid crystal panel of 640×480 dots, if the same operation speed of 10 MHz/dot is used and the high-speed line clock has a speed which is ten times the speed of the line clock, the number of display lines finally read out is 408 and the frame frequency becomes to be 68.6 Hz, thereby enabling the operation frequency range of the liquid crystal panel to be from 65 Hz to 75 Hz. That is, a display can be achieved when the screen size of the liquid crystal panel is greater than the display screen size.

Referring next to FIGS. 17 to 23, description will be given of an alternative embodiment according to the present invention.

Figure 17:
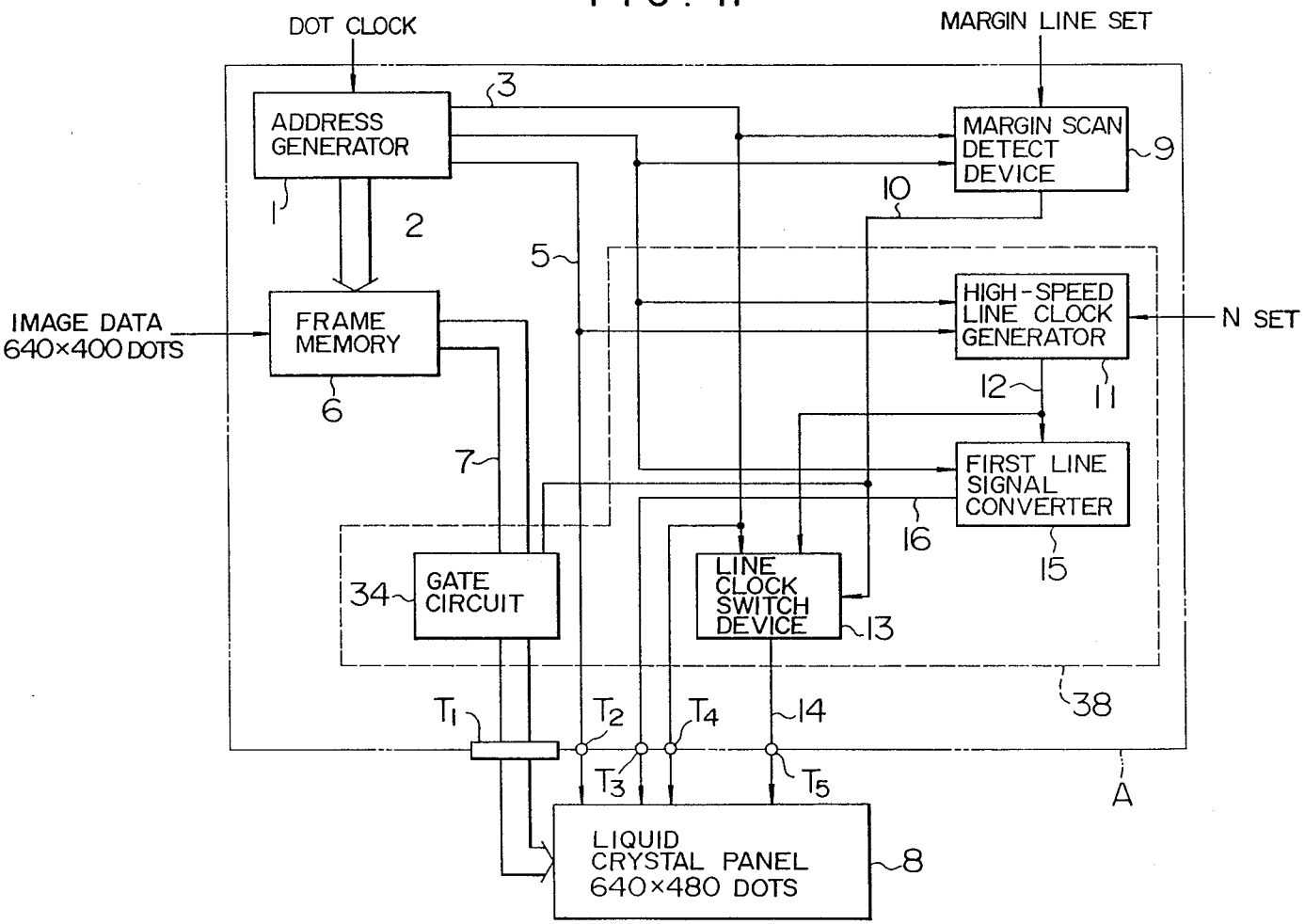
FIG. 17 is a block configuration diagram showing an alternative configuration example according to the present invention.

FIG. 17 is a configuration block diagram of the overall system in which the same components as those of FIG. 5 are assigned with the same reference numerals and description thereof will be omitted. This configuration example differs from that of FIG. 5 in that the data stored in the frame memory 6 does not include the data for the margin display, namely, substantially includes data of 640 dots×400 lines and that a margin display output unit 38 is provided with a gate circuit 34 inserted between a path between the frame memory 7 and the data output terminal $T_1$. Namely, in this configuration, when a line associated with the margin display is to be processed, the high-speed line scan is effected like in the case of the configuration example of FIG. 5; at the same time, the gate circuit 34 disposed on the output side of the frame memory 7 is closed so as to interrupt data to the liquid crystal panel 8.

Figure 18:
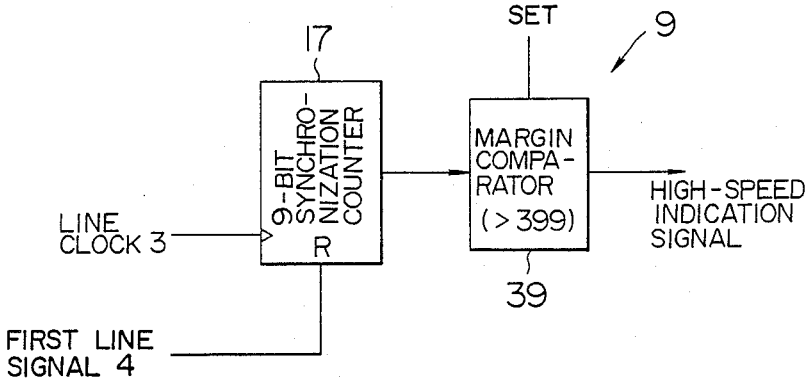
FIG. 18 is a configuration example diagram of a margin scan/detect device of FIG. 17.

FIG. 18 shows a configuration example of the margin scan detect device 9 employed in the configuration block diagram of FIG. 17. In FIG. 18, the margin scan detect device 9 includes a 9-bit synchronization counter 17 and a margin comparator 39. The 9-bit synchronization counter 17 is supplied with a line clock 3 and a first line signal 4 so as to deliver an output therefrom to the margin comparator 39, which compares the output with a setting value (399 in this case). If the output value from the 9-bit synchronization counter 17 is, as a result of the compare operation, in the range from 400 to 407, namely, in the period associated with lines from 401 to 408, the high speed indication signal is set to the high level.

Figure 19:
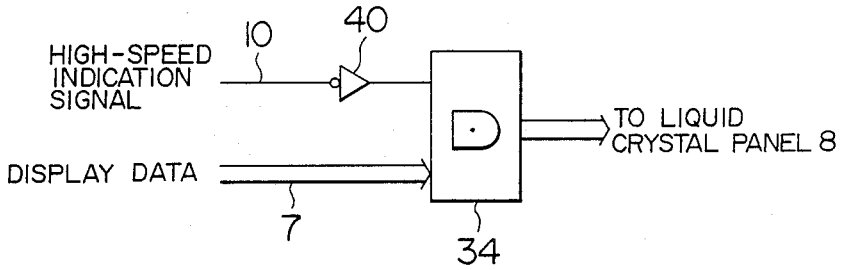
FIG. 19 is a configuration example diagram showing a gate circuit of FIG. 17.

FIG. 19 shows a configuration of the gate circuit 34 included in the configuration block diagram of FIG. 17. The gate circuit 34 includes an AND circuit 34 to be supplied with a signal obtained by inverting the high speed indication signal by use of an inverter 40 and the output from the frame memory 6. In the period described above where the output signal from the margin scan detect device 9 is set to the high level, the address generator 1 outputs an address in an over-scan state in which the address is beyond the range of 640 dots×400 lines, the data 7 read from the frame memory 6 becomes to be unstable. To overcome this difficulty, during the margin period where the high speed indication signal is at the high level, the gate circuit 34 of FIG. 19 is employed such that the signal 10 at the high level is inverted by the inverter 40 to be a signal at a low level so as to supply the liquid crystal panel 8 with data at the low level.

Figure 20:
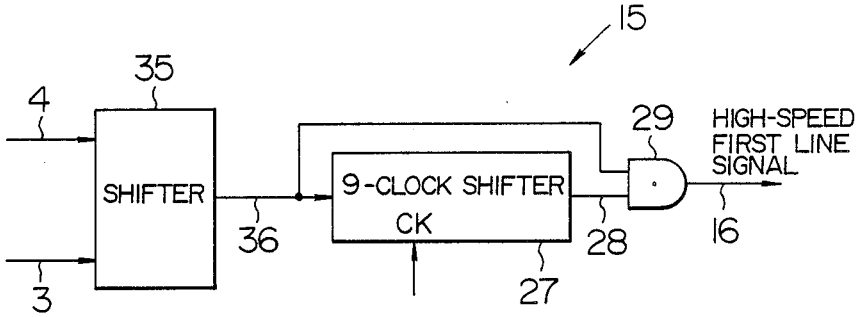
FIG. 20 is a configuration example diagram of a first line signal convert unit of FIG. 17.

In this case, furthermore, since the four final lines of the eight margin lines are associated with the upper margin data on the liquid crystal panel 8, the first line signal converter 15 is configured as shown in FIG. 20. According to the configuration, the first line signal converter 15 includes a shifter 35 to be supplied with a first line signal 4 and a line clock 3, a 9-clock shifter 27 receiving as inputs thereto a new first signal 36 from the shifter 35 and a high-speed line clock 12, and an AND circuit 29 to effect an AND operation between an output 28 from the 9-clock shifter 27 and the new first signal 36, thereby producing a high-speed first signal 16.

Figure 21:
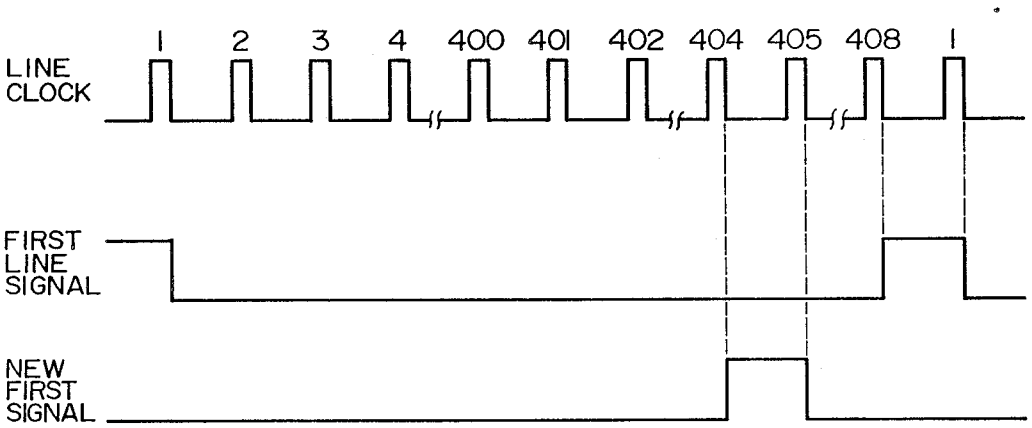
FIG. 21 is a timing chart showing operations of the first line signal convert unit of FIG. 20.

As can be seen from the timing chart of FIG. 21 showing the operation of the first line signal converter 15, the line 405 is assumed to be the first line and the four lines ranging from line 405 to line 408 are used as margin lines on the upper side.

Figure 22:
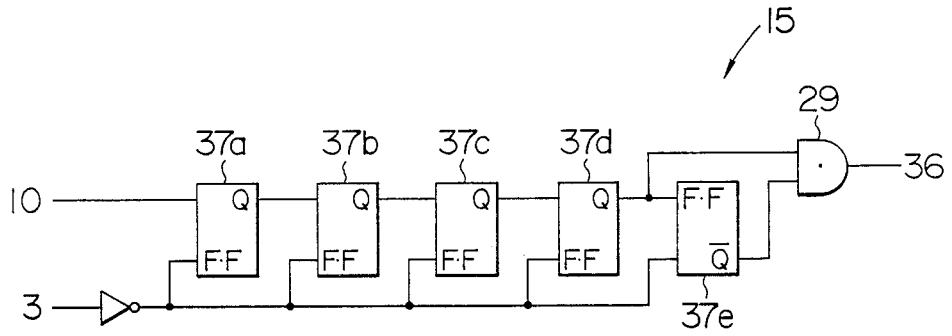
FIG. 22 is a configuration diagram showing another configuration of the first line signal convert unit of FIG. 17.
Figure 23:
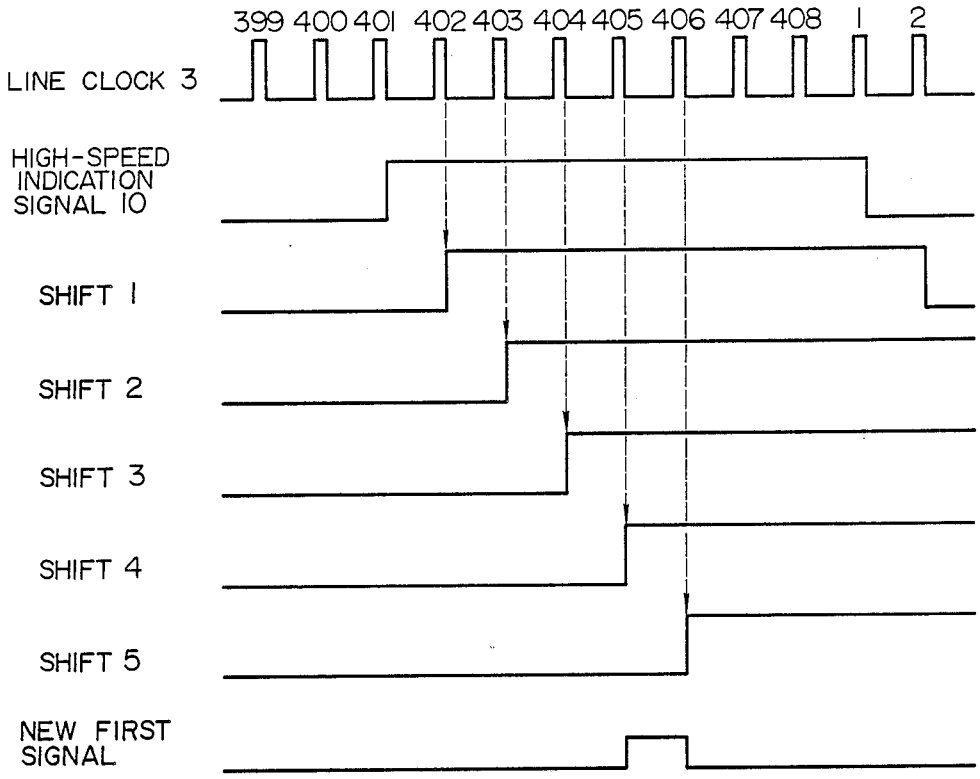
FIG. 23 is a timing chart showing operations of the first line signal convert unit in the configuration of FIG. 22.

FIGS. 22 and 23 respectively show another configuration example of the first line signal converter 15 and a timing chart associated therewith. As compared with the case of the preceding configuration above in which the first line signal is shifted 404 times at the rising edge of the line clock 3 to obtain the new first signal 36, this configuration employs five flip-flops 37*a* to 37*e* and an AND circuit 29 such that the high speed indication signal 10 undergoes a 5-stage shift operation at the rising edge of the line clock 3 so as to obtain a logical product between a Q output from the fourth shift stage and a $\overline{Q}$ output from the fifth shift stage, thereby outputting the product as a new first signal.

The other components of the configuration blocks of FIG. 17 operate in the similar fashion to those of the configuration blocks of FIG. 5 above, and the same operation is similarly implemented also in a case where the data stored in the frame memory 6 does not contain the data for the margin display.

In addition, if the object of the drive display is limited to the liquid panel and the frequency of the high-speed line signal of the high-speed line clock is set to a value sufficiently higher than the response speed of the liquid crystal, the liquid crystal cannot follow any kind data contained in the display data, which enables the similar function to be achieved without disposing the gate circuit and without particularly preparing the data for the margin display. Incidentally, the setting of the frequency of the high-speed line signal can be readily effected depending on the characteristic of the liquid crystal as the drive object.

While the present invention has been described with reference to an embodiment of a liquid crystal panel as an configuration example according to the present invention, it is not restricted by the embodiment but is similarly applicable also to display panels of a line scan type having the two-dimensional structure such as a plasm display and an electroluminescence display.

We claim:

1. A flat display driver in a drive circuit for driving a flat display including:

a memory for storing data to be displayed on a display panel of a line scan type having a two-dimensional structure with N rows by M columns;

means for generating a read address of said memory and a line clock signal;

a data output terminal for supplying the display panel of the two-dimensional line scan type with data read from said memory;

a line clock signal output terminal for supplying the line clock signal from said read address generating means to the display panel wherein said memory is loaded at least with display data for K rows by M columns ($K<N$), said driver further including:

a margin scan detect device in which respective margin lines ($(N-K)/2$) in upper and lower portions of the display panel are set in advance for receiving and for counting the line clock signal from said read address generating means, thereby generating a margin detect signal when the count is equal to a value corresponding to a predetermined value; and a margin display output device operative in response to an input of the margin detect signal from said margin detect device for outputting a margin display signal to the display panel, wherein said margin display output device includes:

means for generating a high-speed line clock signal having a frequency higher than a frequency of the line clock signal output from said read address generating means; and line clock switch means connected to said read address generating means and said high-speed line clock generating means for effecting a switching operation from the line clock signal to the high-speed line clock signal when the margin detect signal is output from said margin scan detect means so as to supply the high-speed line clock signal to said line clock signal terminal.

2. A flat display driver according to claim 1 wherein said memory is loaded with display data constituted with K rows by M columns ($K<N$) and with margin display data prior thereto and posterior thereto in a consecutive fashion, said margin display data includes L lines less than each of said margin lines ($(N-K)/2$).

3. A flat display driver according to claim 2 wherein the high-speed line clock signal is set to a speed which is $((N-K)/2)/L$ times the speed of the ordinary line clock, where L is an integer.

4. A flat display driver according to claim 2 wherein said read address generating means outputs a first line signal indicating a first line of frame data to be displayed and said margin display output device further includes a first line signal converter for outputting a high-speed first line signal in response to an input of a high-speed line clock signal from said high-speed line clock signal generate means and a first line signal output terminal to output the high-speed first line signal from said first line signal converter to the display panel.

5. A flat display driver according to claim 1 wherein said frame memory is loaded only with display data constituted with K rows by M columns ($K<N$), said margin display output means includes gate means inserted between said memory and said data output terminal so as to open and close a path therebetween, and said gate means closes during a period of time when said margin scan detect device is outputting the margin detect signal so as to interrupt the data.

6. A flat display driver according to claim 5, wherein the high-speed line clock signal is set to a speed which is $((N-K)/2)/L$ times the speed of the ordinary line clock, where L is an integer.

7. A flat display driver according to claim 5, wherein said read address generating means outputs a first line signal indicating a first line of frame data to be displayed and said margin display output device further includes a first line signal converter for outputting a high-speed first line signal in response to an input of a high-speed line clock signal from said high-speed line clock signal generating means; and a first line signal output terminal to output the high-speed first line signal from said first line signal converter to the display panel.

8. A flat display driver according to claim 1, wherein said flat display is a liquid crystal display panel and said memory is loaded only with display data of K rows by M columns ($K<N$), said frequency of the high-speed line signal of the high-speed line clock being set to a predetermined value higher than the response speed of the liquid crystal.

* * * * *